US005937682A

United States Patent [19]

Michelini

[11] Patent Number: 5,937,682

[45] Date of Patent: Aug. 17, 1999

[54] FAIL-SAFE FIN MILL MACHINE WRAP-UP DETECTOR

[75] Inventor: Alfred John Michelini, Redford, Mich.

[73] Assignee: Ford Motor Company, Dearborn, Mich.

[21] Appl. No.: 09/143,332

[22] Filed: Aug. 28, 1998

[51] Int. Cl.[6] ..... B21B 33/02

[52] U.S. Cl. ..... 72/5; 72/4; 72/187

[58] Field of Search ..... 72/3–5, 8.3, 11.1, 72/16.2, 17.3, 18.1, 27.1, 31.01, 31.07, 187, 365.2; 226/24, 25, 38, 39, 40; 340/650, 679; 324/511, 756, 758

[56] References Cited

U.S. PATENT DOCUMENTS

| | | | |
|---|---|---|---|
| 2,349,104 | 5/1944 | Morgan . | |
| 2,434,406 | 1/1948 | Herath et al. . | |
| 3,076,227 | 2/1963 | Hardesty . | |
| 3,319,087 | 5/1967 | Wintriss . | |
| 3,656,139 | 4/1972 | Wintriss . | |
| 3,665,742 | 5/1972 | Felt et al. . | |
| 3,921,428 | 11/1975 | Freres . | |
| 4,035,790 | 7/1977 | Farmer . | |
| 4,077,056 | 2/1978 | Galiana . | |
| 4,191,954 | 3/1980 | Faris et al. . | |
| 4,797,662 | 1/1989 | Graham et al. . | |
| 5,097,688 | 3/1992 | Taylor et al. | 72/5 |
| 5,250,909 | 10/1993 | Bitts | 324/542 |
| 5,628,221 | 5/1997 | Pardi et al. . | |
| 5,640,870 | 6/1997 | Michelini et al. . | |
| 5,640,871 | 6/1997 | Lisk et al. | 72/187 |
| 5,758,535 | 6/1998 | Pardi et al. | 72/187 |
| 5,890,641 | 4/1999 | Pfautz | 72/4 |

*Primary Examiner*—Joseph J. Hail, III
*Assistant Examiner*—Ed Tolan
*Attorney, Agent, or Firm*—Donald A. Wilkinson; Roger L. May

[57] ABSTRACT

A fin mill machine for forming electrically conductive strip stock into corrugated fin material includes a form roller for forming corrugations in the strip stock, which is at an electrical common. A detector detects when the strip stock wraps up around the form roller. The detector includes an electrical circuit having a source connected to a load by a probe. The probe is positioned adjacent the form roller to contact the strip stock when the strip stock wraps up around the form roller such that the electrical circuit has an effective load different than the load. A controller is operable with the detector to monitor the effective load of the electrical circuit. The controller disables the form roller when the effective load of the electrical circuit is indicative of the probe contacting the strip stock.

16 Claims, 2 Drawing Sheets

10
12
14
16
18
20
20
22
24
26
28
30
32
34
36
38
40
42a
42b
44
46
48
52
60
64
66
68
70
LOAD
CONTROLLER

FAIL-SAFE FIN MILL MACHINE WRAP-UP DETECTOR

TECHNICAL FIELD

The present invention relates generally to fin forming machines and, more particularly, to fin forming machines having detectors for detecting the wrap-up of strip stock around the form rollers of the machines.

BACKGROUND ART

Conventional serpentine fin machines make strips of fins by infeeding a flat sheet of metallic strip stock and outputting a series of metallic strips having corrugations therein. There are many uses for corrugated fin strips, particularly for vehicle components such as radiator, heater core, evaporator, and condenser fins, among others. The typical fin machine generally works by feeding the continuous length of strip stock between at least one pair of form rollers having interleaved teeth to bend the stock and form corrugations (fins).

During the operation of a fin machine, the strip stock may wrap up around a form roller. Strip stock wrapping up around form rollers can severely damage the rollers.

To prevent this problem, fin machines use a wrap-up detector to detect the wrap-up of strip stock around the form rollers. The typical wrap-up detector includes an electrical conductive probe positioned adjacent the form rollers at a sensing position. The probe is connected to an electrical circuit having a resistive sensitive relay. When the strip stock, which is electrically grounded, wraps up around a form roller, it contacts the probe causing the electrical circuit to ground out. The relay detects the grounding condition and immediately disables the fin machine and enables an alarm. To restart the fin machine, the operator must first move the probe away from the sensing position and then clear the strip stock obstruction. The operator should then move the probe back to the sensing position prior to enabling the fin machine.

A problem with typical wrap-up detectors is that if the probe is disconnected from the relay or is misplaced from the sensing position then a wrap-up condition will not be detected thereby resulting in the destruction of the form roller.

DISCLOSURE OF THE INVENTION

A general object of the present invention is to provide a fail-safe fin mill machine wrap-up detector for detecting when a probe of the detector is misplaced from a sensing position, disconnected from the detector, or contacting strip stock during a wrap-up condition.

In carrying out the above object and other objects, features, and advantages, the present invention provides a fin mill machine for forming electrically conductive strip stock into corrugated fin material. The machine includes a form roller for forming corrugations in the strip stock, which is at an electrical common. A detector detects when the strip stock wraps up around the form roller. The detector includes an electrical circuit having a source connected to a load by a probe. The probe is positioned adjacent the form roller to contact the strip stock when the strip stock wraps up around the form roller such that the electrical circuit has an effective load different than the load. A controller is operable with the detector to monitor the effective load of the electrical circuit. The controller disables the form roller when the effective load of the electrical circuit is indicative of the probe contacting the strip stock.

The advantages accruing to the present invention are numerous. The present invention ensures that wrap-up detectors are in place and functioning correctly. In the event of a wrap-up condition, the fin mill machine shuts down thereby protecting the form roller.

These and other features, aspects, and embodiments of the present invention will become better understood with regard to the following description, appended claims, and accompanying drawings.

BEST MODES FOR CARRYING OUT THE INVENTION

Figure 1:
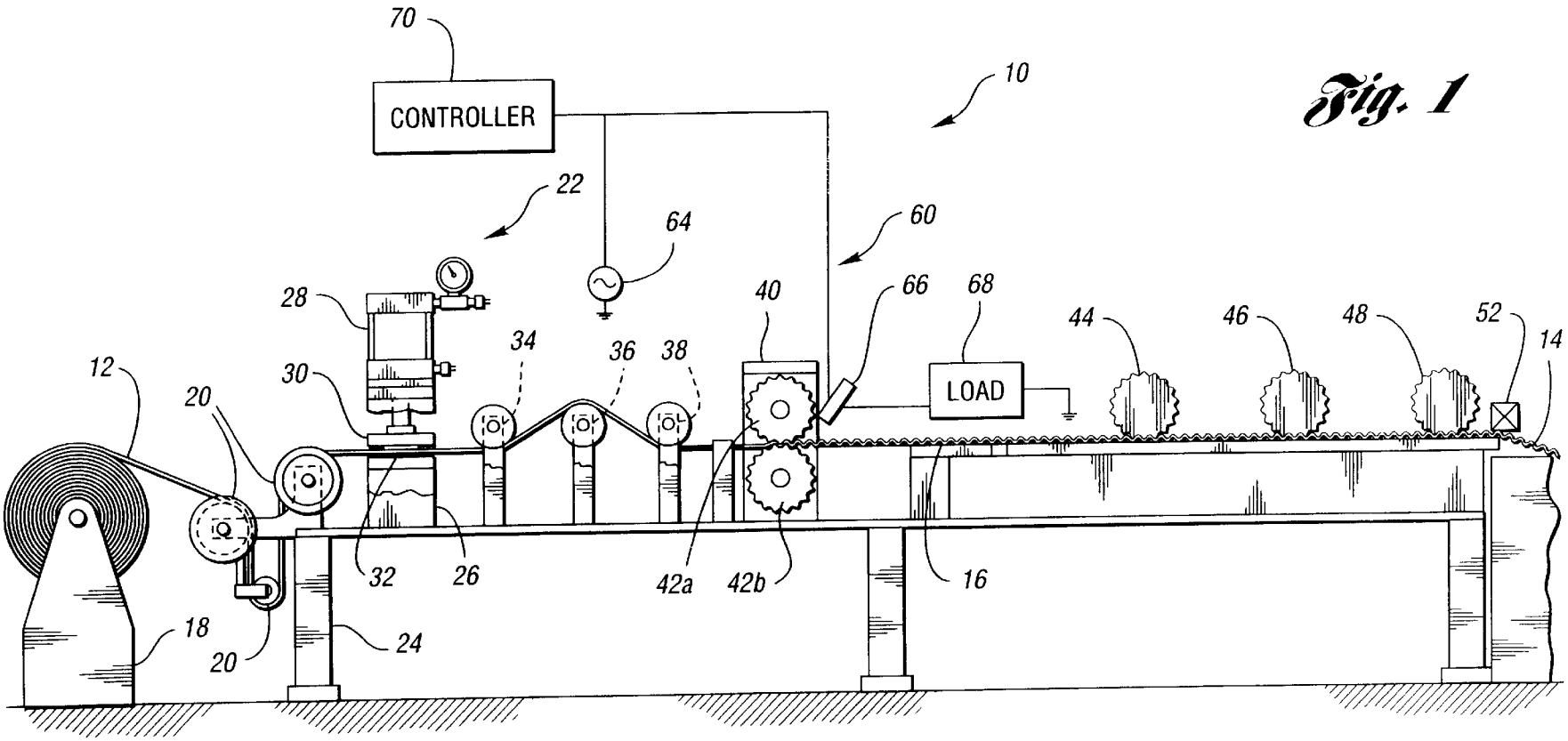
FIG. 1 illustrates a fin mill machine having a detector for detecting the wrap-up of strip stock around the form rollers of the machine in accordance with the present invention.

Referring now to FIG. 1, a fin mill machine 10 is employed for pulling electrically conductive flat strip stock 12 into it and producing finished fin strips 14 having precisely formed corrugations (fins) 16 therein. Strip stock 12 is secured to a base 18 and is at an electrical common with fin mill machine 10. Strip stock 12 is fed through three guide rollers 20 before feeding into tension control subsystem 22, which is mounted to a fin mill machine base 24.

Tension control subsystem 22 includes a mounting block 26 mounted to machine base 24 aligned with a pneumatic cylinder 28 having a plunger 30 protruding therefrom toward the mounting block. Two pieces of frictional material 32, such as cardboard or felt pads, surround strip stock 12 as it extends between mounting block 26 and plunger 30.

Strip stock 12 next threads through three rollers 34, 36, and 38 into a star wheel formation station 40 mounted to machine base 24. Formation station 40 includes a pair of form rollers 42(*a-b*) which form corrugations 16 in strip stock 12. Packing stations 44, 46, and 48 are mounted on machine base 24 downstream of formation station 40. Packing stations 44, 46, and 48 limit the forward movement of the newly formed corrugations 16, thus packing the corrugations tightly together.

Strip stock 12 extends through form rollers 42(*a-b*) and is received between a pair of fin guards mounted to machine base 24, which form a passage tunnel 50 that retains and guides the packed fins in fin mill machine 10. Beyond the third packing station 48, a cutting mechanism 52 cuts the fin strips to a proper length before the finished fins leave fin mill machine 10.

Figure 2:
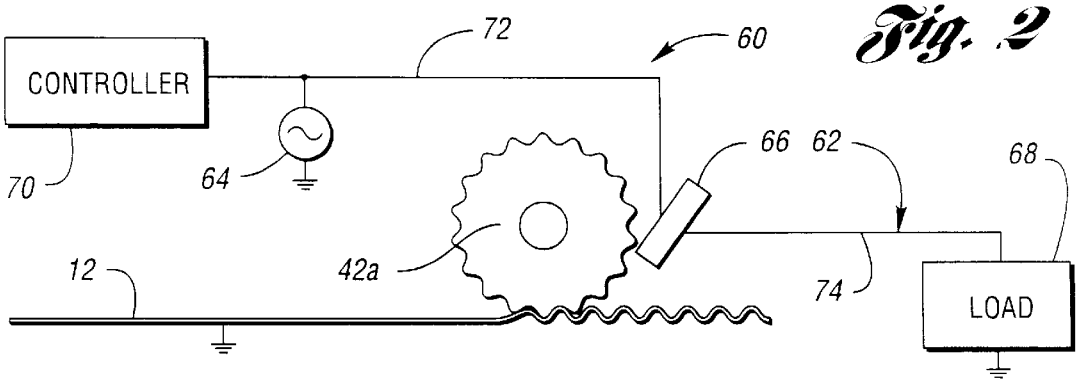
FIG. 2 illustrates the detector of the fin mill machine during normal operation.
Figure 3:
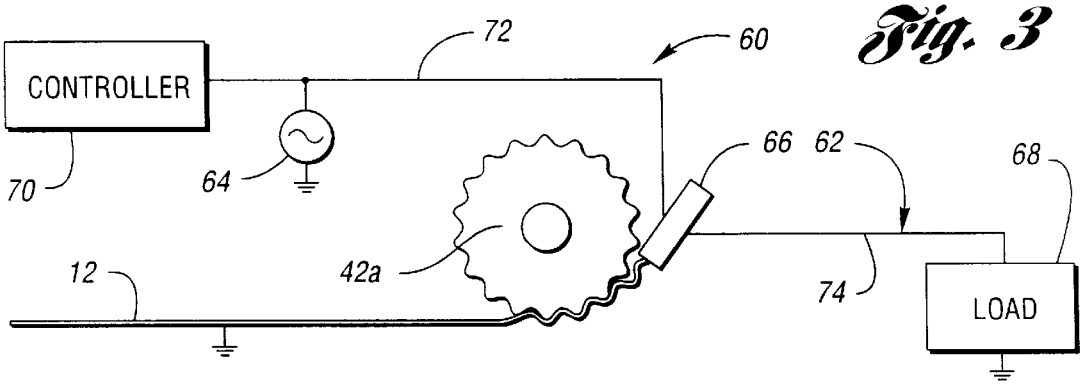
FIG. 3 illustrates the detector of the fin mill machine when the strip stock contacts the probe of the detector.

Referring now to FIGS. 2 and 3 with continual reference to FIG. 1, fin mill machine 10 includes a wrap-up detector 60 for each form roller 42(*a-b*) for detecting when strip stock 12 wraps up around either of the form rollers. Wrap-up detectors 60 for form rollers 42(*a-b*) are identical and only the wrap-up detector for form roller 42*a* is shown in FIGS. 1–3.

Wrap-up detector 60 includes an electrical circuit 62 having a battery source 64, a probe 66, and a load 68. Probe 66 connects source 64 to load 68. Source 64 and load 68 are connected to the electrical common of machine base 24 with strip stock 12.

Figure 4:
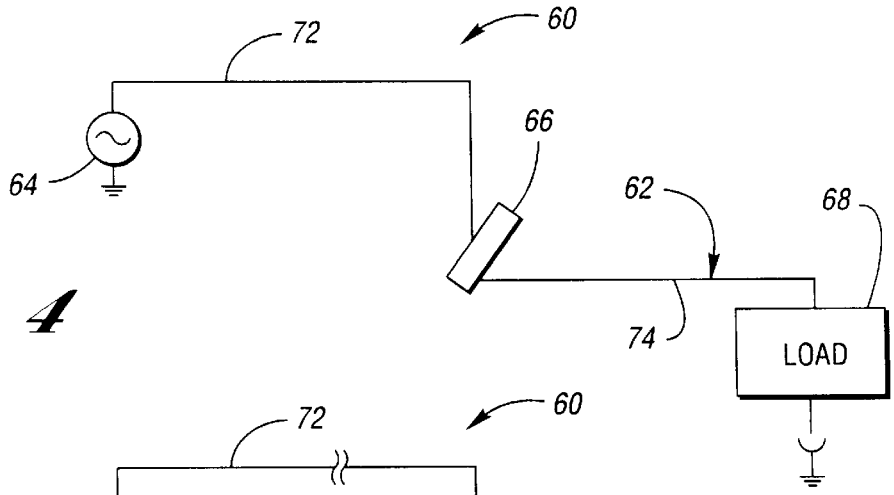
FIG. 4 illustrates the probe of the detector at a position other than the sensing position.

Source 64 provides electrical current through electrical circuit 62. The current passes from source 64 through probe 66 and load 68 to the electrical common of machine base 24. Probe 66 is an electrically conductive metal plate connected to load 68 by a wire 74. Probe 66 is movable between a sensing position adjacent form roller 42*a* as shown in FIGS. 2 and 3 and other positions away from the sensing position. At the sensing position, probe 66 is connected to source 64 by a wire 72 and connects the source to load 68. When probe 66 is at any position other than the sensing position, load 68 is disconnected from the electrical common (as shown in FIG. 4), and, thereby, source 64 is electrically disconnected from the load.

Load 68 is fixedly attached to machine base 24 by a metal mounting bracket or mounting bolt (shown in FIG. 1) to be connected to the electrical common. Load 68 is preferably a resistor having a resistance. Probe 66 is fixedly attached to the mounting bracket or bolt via load 68. The mounting bracket or bolt is removable from machine base 24 to move the probe away from form roller 42*a*.

During normal operation of fin mill machine 10 with probe 66 in the sensing position as shown in FIG. 2, electrical circuit 62 has an effective load equal to the resistance of load 68.

Probe 66 is positioned at the sensing position adjacent form roller 42*a* to contact strip stock 12 when the strip stock wraps around the form roller as shown in FIG. 3. When strip stock 12 contacts probe 66, load 68 is grounded out from electrical circuit 62 and the electrical circuit is short circuited. The current from source 64 passes through probe 66 and strip stock 12 straight to the electrical common, instead of passing through load 68 to the electrical common. Thus, electrical circuit 62 has an effective load different than the resistance of load 68.

A controller 70, preferably an electrical relay, is operable with detector 60 to monitor the effective load of electrical circuit 62 during operation of fin mill machine 10. Controller 70 is also operable with fin mill machine 10 to disable form roller 42*a* when the effective load of electrical circuit 62 is indicative of probe 66 contacting strip stock 12. The effective load is indicative of probe 66 contacting strip stock when it is zero resistance, i.e., electrical circuit 62 is short circuited.

Controller 70 also disables form roller 42*a* when the effective load of electrical circuit 62 is indicative of probe 66 being in a position other than the sensing position. This may occur when the mounting bracket or bolt is removed from machine base 24.

Referring now to FIG. 4, probe 66 is at a position other than the sensing position and, as a result, load 68 is disconnected from the electrical common. When load 68 is disconnected from the electrical common, electrical circuit 62 is open and current cannot flow from source 64 to the load. Thus, electrical circuit 62 has an effective load of infinite resistance which is different than the resistance of load 68.

Figure 5:
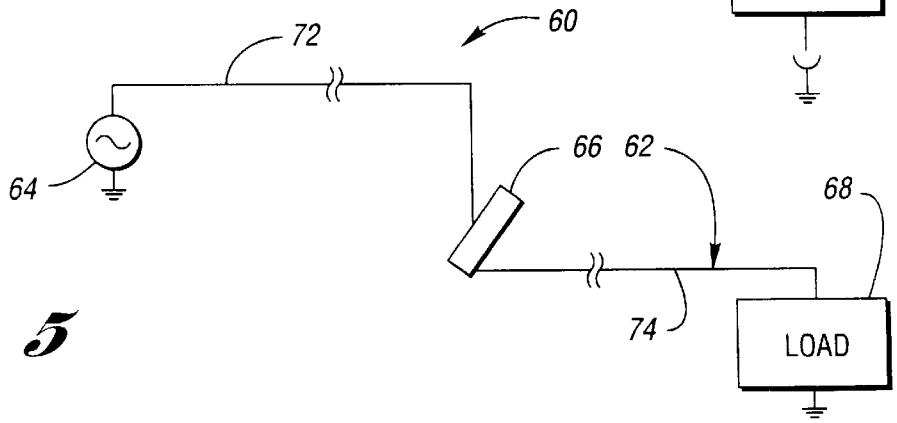
FIG. 5 illustrates the probe and the source of the detector disconnected from each other by broken wires.

Controller 70 senses that electrical circuit 62 has an effective load of infinite resistance and disables form roller 42*a*. The effective load of infinite resistance is indicative of load 68 being disconnected from the electrical common because probe 66 is misplaced from the sensing position, as shown in FIG. 4, or is indicative of source 64 being disconnected from the load because either of the wires 72 and 74 connecting the source to the load are broken, as shown in FIG. 5. Controller 70 enables form roller 42*a* when the effective load of electrical circuit 62 is equal to the resistance of load 68 which is indicative of probe 66 being positioned at the sensing position and connecting source 64 to the load and not contacting strip stock 12.

In an alternative embodiment, controller 70 may include circuitry to set low and high resistance thresholds. The low resistance threshold corresponds to the circuit condition in which probe 66 contacts strip stock 12. The high resistance threshold corresponds to the open circuit condition in which either probe 66 is misplaced from the sensing position or either of wires 72 and 74 are broken. For example, if the resistance of resistor 68 is 10 kohms then the lower threshold may be 3 kohms and the higher threshold may be 60 kohms. Thus, if the effective load of electrical circuit 62 is below 3 kohms or above 50 kohms, then controller 70 disables fin mill machine 10 until the effective load is set back to 10 kohms.

While the best modes for carrying out the present invention have been described in detail, those familiar with the art to which the present invention relates will recognize various alternative designs and embodiments for practicing the present invention as defined by the following claims.

What is claimed is:

1. A fin mill machine for forming electrically conductive strip stock into corrugated fin material, the machine comprising:

a form roller for forming corrugations in the strip stock, wherein the strip stock is at an electrical common;

a detector for detecting when the strip stock wraps up around the form roller, the detector including an electrical circuit having a source connected to a load by a probe, wherein the probe is positioned adjacent the form roller to contact the strip stock when the strip stock wraps up around the form roller such that the electrical circuit has an effective load different than the load; and a controller operable with the detector to monitor the effective load of the electrical circuit, wherein the controller disables the form roller when the effective load of the electrical circuit is indicative of the probe contacting the strip stock.

2. The machine of claim 1 wherein:

the probe is movable to a sensing position adjacent the form roller, wherein in the sensing position the probe connects the source to the load and in all other positions the source is disconnected from the load, wherein the controller disables the form roller when the effective load of the electrical circuit is indicative of the probe being in a position other than the sensing position.

3. The machine of claim 1 wherein:

the controller disables the form roller when the effective load of the electrical circuit is indicative of the source being disconnected from the probe.

4. The machine of claim 1 wherein:

the controller disables the form roller when the effective load of the electrical circuit is indicative of the probe being disconnected from the load.

5. The machine of claim 1 wherein:

the load is a resistor.

6. The machine of claim 1 wherein:

the source and the load are connected to the electrical common.

7. The machine of claim 1 wherein:

the controller is an electrical relay.

8. In a fin mill machine having a form roller for forming corrugations in electrically conductive strip stock, wherein the strip stock is at an electrical common, a detector for detecting when the strip stock wraps up around the form roller, the detector comprising:

an electrical circuit having a source connected to a load by a probe, wherein the probe is positioned adjacent the form roller to contact the strip stock when the strip stock wraps up around the form roller such that the electrical circuit has an effective load different than the load; and a controller operable with the electrical circuit to monitor the effective load of the electrical circuit, wherein the controller disables the form roller when the effective load of the electrical circuit is indicative of the probe contacting the strip stock.

9. The machine of claim 8 wherein:

the probe is movable to a sensing position adjacent the form roller, wherein in the sensing position the probe connects the source to the load and in all other positions the source is disconnected from the load, wherein the controller disables the form roller when the effective load of the electrical circuit is indicative of the probe being in a position other than the sensing position.

10. The machine of claim 8 wherein:

the controller disables the form roller when the effective load of the electrical circuit is indicative of the source being disconnected from the probe.

11. The machine of claim 8 wherein:

the load is a resistor.

12. The machine of claim 8 wherein:

the source and the load are connected to the electrical common.

13. The machine of claim 8 wherein:

the controller is an electrical relay.

14. A method of forming electrically conductive strip stock into corrugated material using a fin mill machine having a form roller for forming corrugations in the strip stock, wherein the strip stock is at an electrical common, the method comprising:

providing a detector for detecting when the strip stock wraps up around the form roller, the detector including an electrical circuit having a source connected to a load by a probe;

positioning the probe adjacent the form roller to contact the strip stock when the strip stock wraps up around the form roller such that the electrical circuit has an effective load different than the load;

monitoring the effective load of the electrical circuit; and disabling the form roller when the effective load of the electrical circuit is indicative of the probe contacting the strip stock.

15. The method of claim 14 wherein the probe is movable to a sensing position adjacent the form roller, wherein in the sensing position the probe connects the source to the load and in all other positions the source is disconnected from the load, the method further comprising:

disabling the form roller when the effective load of the electrical circuit is indicative of the probe being in a position other than the sensing position.

16. The method of claim 14 further comprising:

disabling the form roller when the effective load of the electrical circuit is indicative of the source being disconnected from the probe.

* * * * *